US010641026B2

(12) United States Patent
Qiu

(10) Patent No.: US 10,641,026 B2
(45) **Date of Patent: *May 5, 2020**

(54) AUTOMATIC DOOR STOPPING-CLOSING DEVICE AND DOOR

(71) Applicant: CMECH (GUANGZHOU) LTD., Guangzhou (CN)

(72) Inventor: Jia Sen Qiu, Guangzhou (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/017,629

(22) Filed: Jun. 25, 2018

(65) Prior Publication Data

US 2018/0328092 A1 Nov. 15, 2018

Related U.S. Application Data

(63) Continuation of application No. 15/594,127, filed on May 12, 2017, now Pat. No. 10,006,237.

(51) Int. Cl.
*E05F 3/22* (2006.01)
*E05C 17/04* (2006.01)
(Continued)

(52) U.S. Cl.
CPC ..... *E05F 3/22* (2013.01); *E05C 17/04* (2013.01); *E05C 17/085* (2013.01); *E05C 17/30* (2013.01);
(Continued)

(58) Field of Classification Search
CPC ..... E05C 17/04; E05C 17/08; E05C 17/085; E05C 17/12; E05C 17/14; E05C 17/20; E05C 17/22; E05C 17/30; E05C 17/34; E05C 17/345; E05C 17/44; E05C 17/48; E05C 17/50; E05C 17/305; E05F 3/22; E05F 3/02; E05F 3/04; E05F 3/108; E05F 3/221; E05F 5/027; E05B 15/0053
See application file for complete search history.

(56) References Cited

U.S. PATENT DOCUMENTS 1,370,975 A 3/1921 Knowlson
2,235,875 A 3/1941 Galamb
(Continued)

FOREIGN PATENT DOCUMENTS

WO 2016033793 A1 3/2016

*Primary Examiner* — Jeffrey O'Brien
(74) *Attorney, Agent, or Firm* — McKee, Voorhees & Seas, PLC

(57) ABSTRACT

An automatic door stopping-closing device comprises a cylinder with a connecting rod, one end of which is connected to a door; a bracket assembly on the door frame, comprising a hook connected with the other end of the rod, a movable lug cooperated with the hook, and a pull rod cooperated with the movable lug, wherein the pull rod and the hook can be engaged or disengaged. After the door is opened, the door can be kept open securely through the cooperation between the hook and the movable lug; and the door can be closed automatically by a slight push, through the cooperation between two of the hook, the movable lug and the pull rod. The automatic door stopping-closing device holds the door open without external force after the door is opened, and closes the door automatically after a slight push.

13 Claims, 5 Drawing Sheets

(51) Int. Cl.

| | |
|---|---|
| ***E05C 17/08*** | (2006.01) |
| ***E05F 3/02*** | (2006.01) |
| ***E05F 3/04*** | (2006.01) |
| ***E05C 17/30*** | (2006.01) |
| ***E05F 5/02*** | (2006.01) |
| *E05B 15/00* | (2006.01) |

(52) U.S. Cl.

CPC ..... *E05C 17/305* (2013.01); *E05F 3/02* (2013.01); *E05F 3/04* (2013.01); *E05F 3/221* (2013.01); *E05F 5/027* (2013.01); *E05B 15/0053* (2013.01); *E05Y 2900/132* (2013.01)

(56) References Cited

U.S. PATENT DOCUMENTS

| | | | | |
|---|---|---|---|---|
| 2,707,798 | A | 5/1955 | Comey | |
| 3,661,616 | A | 5/1972 | Miyamichi | |
| 4,194,264 | A | 3/1980 | Stoffregen | |
| 5,906,026 | A | 5/1999 | Junttila | |
| 6,634,057 | B2 * | 10/2003 | Wartian | E05C 17/085 16/66 |
| 6,634,058 | B1 | 10/2003 | Lin | |
| 6,640,387 | B2 | 11/2003 | Alonso | |
| 6,938,302 | B2 | 9/2005 | Lin | |
| 7,134,168 | B1 | 11/2006 | Qing | |
| 7,963,573 | B2 | 6/2011 | Blomqvist | |
| 9,009,917 | B2 * | 4/2015 | Chao | E05F 1/002 16/66 |
| 9,151,100 | B2 | 10/2015 | Chao | |
| 9,447,610 | B2 | 9/2016 | Ou et al. | |
| 9,920,562 | B2 | 3/2018 | Stanton | |
| 2003/0110589 | A1 | 6/2003 | Lin | |
| 2003/0126716 | A1 | 7/2003 | Lin | |
| 2004/0148733 | A1 | 8/2004 | Wartian | |
| 2005/0172450 | A1 | 8/2005 | Shiu | |
| 2005/0198773 | A1 | 9/2005 | Alonso | |
| 2007/0271730 | A1 | 11/2007 | Alonso | |
| 2015/0075236 | A1 | 3/2015 | Ou et al. | |
| 2016/0053522 | A1 | 2/2016 | Ou et al. | |
| 2017/0198506 | A1 | 7/2017 | Sowter | |

* cited by examiner

AUTOMATIC DOOR STOPPING-CLOSING DEVICE AND DOOR

CROSS-REFERENCE TO RELATED APPLICATIONS

This is a Continuation Application of U.S. Ser. No. 15/594,127 filed May 12, 2017, which is herein incorporated by reference in its entirety.

BACKGROUND OF THE INVENTION

In daily life, people will feel inconvenient when opening and closing a door: firstly, a door won't remain open without external force after it is opened, and people always block the door with some supports to keep the door open, which is inconvenient and affects the neatness and beauty; secondly, the door will be closed only if people keeps driving the door to move by hand or a large force is exerted, which is inconvenient or will cause noise pollution.

At present, to solve the inconvenience of closing the door, ordinary door closers are widely used. After the door is opened, it can be closed automatically without an additional closing operation of the user, thus it is timesaving convenient to the consumers. But if the consumers need to go in and out for several times in a short time, they must repeatedly open the door closed by the ordinary door closer, thus it is timewasting and inconvenient. So, ordinary door closers bring convenience to consumers as well as some inconvenience at the same time, degrading the user experience.

Door closer devices having a hold open feature are known, primarily for pneumatic door closers. However, these pneumatic door closers continue to suffer from an undesirable "bounce" during closing. Also, these pneumatic door closers utilize components that bite into the rod of the closer, and through friction, hold the door open. Hydraulic door closers are also known with a hold open feature. One challenge with such hydraulic door closers is to prevent physical contact with the closer rod. Thus, the rod must be smooth and free of burrs for the hydraulic closer, otherwise, the internal O-ring will wear down and eventually lose its seal, thus causing a failure with the hydraulic closing system.

Chinese utility model patent with a publication number of CN202501702U discloses an automatic stopping device comprising a door body, and a lower part of the door body is configured with a lower hinge, on which a rotating shaft and a door stop arched upwards are configured. A gasket, configured with a rotating shaft hole, is provided on a lower end face of the door body, and a downward protrusion is located on one side of the rotating shaft hole. The rotating shaft on the lower hinge passes through the rotating shaft hole in the gasket. When the door is opening, the downward protrusion of the gasket installed at the lower part of the door collides with the upward arched door stop mounted on the lower hinge. As the door stop is mounted obliquely, the protrusion of the gasket on the door body will not bypass the door stop on the lower hinge until the door is opened to a certain angle, and the door is blocked by the door stop on the lower hinge when the door is closing. Thus, the door can be kept open. However, the device is unable to maintain the door open immovably as the door may keep opening optionally. Meanwhile, some components of the device are needed to be installed on the lower end face of the door, so a space of the lower end face of the door will be required, bringing limitations.

Accordingly, a primary objective of the present invention is the provision of a door closer which overcomes the problems of the prior art.

Another objective of the present invention is the provision of a door closer with a hold open feature located on the jam bracket.

A further objective of the present invention is the provision of a hydraulic or pneumatic door closer having a hold open feature which does not detrimentally affect the closer.

Still another objective of the present invention is the provision of a hydraulic or pneumatic door closer which will retain the door in an open position without biting into the closer rod.

Yet another objective of the present invention is the provision of a door closer with a hold open function derived outside the closure cylinder.

A further objective of the present invention is the provision of a door closer having a hold open function, wherein the closer is economical to manufacture, and durable and safe in use.

These and other objectives will become apparent from the following description of the invention.

SUMMARY OF THE INVENTION

An aspect of the invention is to provide an automatic door stopping-closing device on a door, in order to solve the above problems. Thus, the door can be kept open without external force after the door is opened, and the door can be closed automatically by the device under a slight push to begin the door is closing.

The invention provides a technical solution as follows.

An automatic door stopping-closing device comprises:

a connecting rod, one end of which is connected to a door;

a bracket assembly configured on the door frame, the bracket having a hook connected with the other end of the connecting rod, a movable lug cooperated with the hook, and a pull rod cooperated with the movable lug, wherein the pull rod and the hook can be separated or connected;

when the door is opening, the connecting rod drives the hook to move clockwise under external force, whereby the hook comes in contact with the movable lug and drives the movable lug to rotate counterclockwise; when the movable lug rotates to its limit position, the external force will disappear; then the movable lug will rotate clockwise to its stop position under a first reset force, whereby the hook is locked by the movable lug, and the door is stopped and held in a lockout or open condition;

when the door is closing, the connecting rod drives the hook to further move clockwise under external force, whereby the hook comes in contact with the pull rod and drives the pull rod to slide leftwards; the pull rod further drives the movable lug to rotate clockwise, whereby the movable lug and the hook are apart from each other and are unlocked; after the movable lug and the hook are unlocked, the external force will disappear, and then the connecting rod drives the hook to rotate counterclockwise under a door-closing force, making the hook come in contact with the movable lug and further drive the movable lug to rotate clockwise, until the hook and the movable lug are apart from each other; after the hook and the movable lug are separated, the hook keeps rotating counterclockwise under a door-closing force, and the movable lug rotates counterclockwise to its initial position under a second reset force;

the first reset force and the second reset force are in opposite directions.

In some embodiments, the hook is configured with a first hook tooth cooperated with the movable lug and a second hook tooth cooperated with the pull rod.

In some embodiments, the moveable lug is configured with a first lug tooth cooperated with the hook and a second lug tooth cooperated with the pull rod.

In some embodiments, a torsional spring is configured in the moveable lug, and the first reset force and the second reset force are the reset force of the torsional spring.

In some embodiments, the pull rod is configured with a first protrusion cooperated with the hook and a second protrusion cooperated with the moveable lug.

Further, the pull rod is in a long strip shape, and the first protrusion and the second protrusion are configured at the two ends of the pull rod, respectively.

In some embodiments, the bracket assembly further comprises a housing in which the hook, the movable lug and the pull rod are located.

In some embodiments, a dowel pin is configured in the hook and a dowel pin hole matched with the dowel pin is configured in the housing; when the movable lug rotates to its limit position, a crash will be generated since the dowel pin bumps into the dowel pin hole.

Further, the dowel pin comprises a fixing ring, a pin body configured in the fixing ring and a spring configured in the pin body.

In some embodiments, the housing is provided with an espagnolette which extends through the housing for fastening.

In some embodiments, the connecting rod is connected with the door by a hinge.

In some embodiments, the bracket assembly also comprises an extension sheet where a number of screw holes are provided. The screw holes are configured to be fixed to the door frame in cooperation with self-tapping screws.

In addition, the present invention also provides a door configured with an automatic door stopping-closing device.

The technical solution of this invention has following benefits:

With the automatic door hold open or stopping and closing device and door of the present invention, the door can be kept open securely without external force after the door is opened, and the door can be closed automatically just by a slight push without manually driving the door to move by hand when the door is closing. In addition, the automatic door stopping-closing device of the present invention is easy to disassemble and assemble.

BRIEF DESCRIPTION OF THE DRAWINGS

The invention is further illustrated with reference to accompanying figures.

DETAILED DESCRIPTION OF THE PREFERRED EMBODIMENTS

In order to fully understand the purposes, features and effects of the invention, the designs, specific structures and the achieved effects of the invention are further explained with reference to the accompanying figures.

Figure 1:
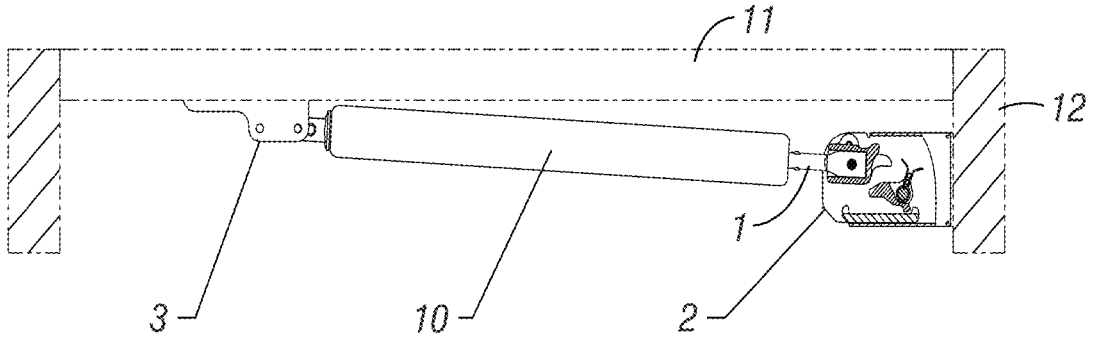
FIG. 1 is an assembly plan view of an automatic door-stopping and closing device of an embodiment of the invention when the door is closed.
Figure 2:
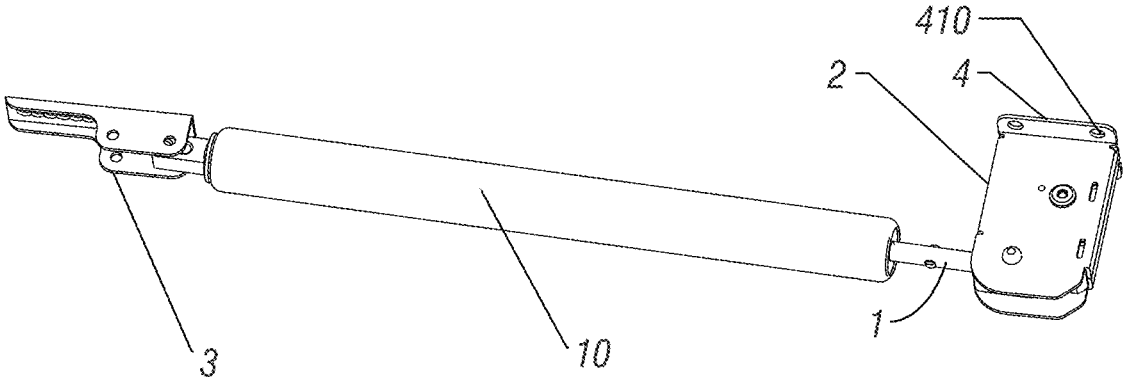
FIG. 2 is a perspective view of an automatic door stopping and closing device of an embodiment of the invention.
Figure 3:
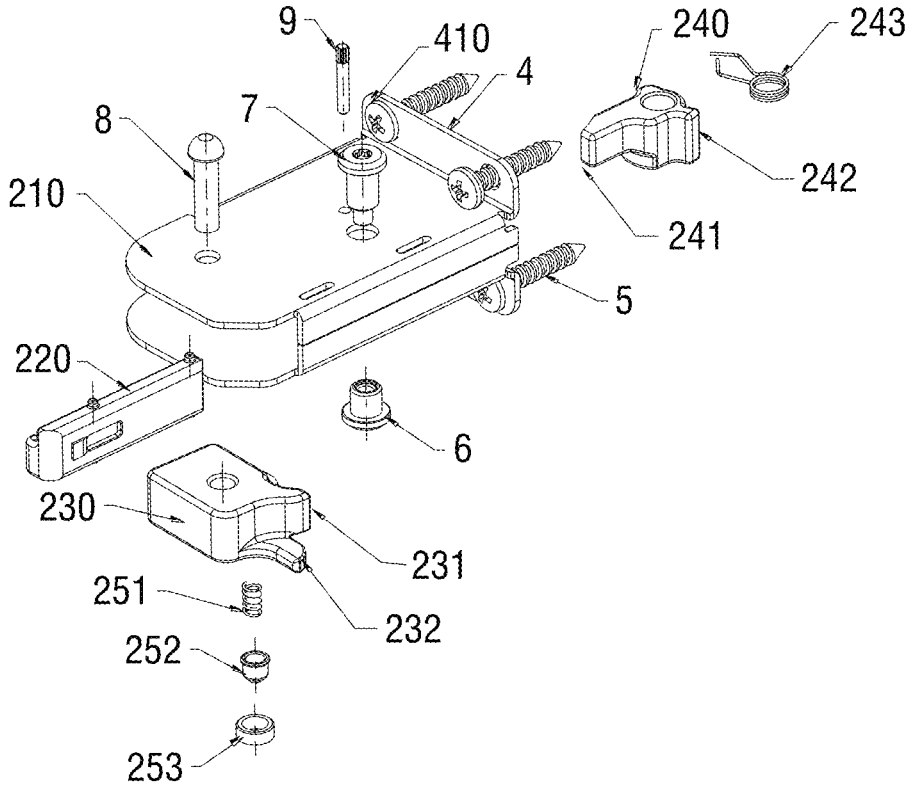
FIG. 3 is an exploded view of the bracket assembly of an automatic door stopping and closing device of an embodiment of the invention.

As shown in FIGS. 1, 2 and 3, the automatic door stopping and closing device of this embodiment comprises a cylinder 10 with an extendible and retractable connecting rod 1, one end of which is connected to a door 11; and bracket assembly 2 which is configured on a door frame 12 and comprises a hook 230 connected with the other end of the connecting rod 1, a movable lug 240 cooperated with the hook 230, a pull rod 220 cooperated with the movable lug 240, wherein the pull rod 220 and the hook 230 can be separated or connected. The cylinder 10 and rod assembly may be hydraulic or pneumatic.

Figure 7:
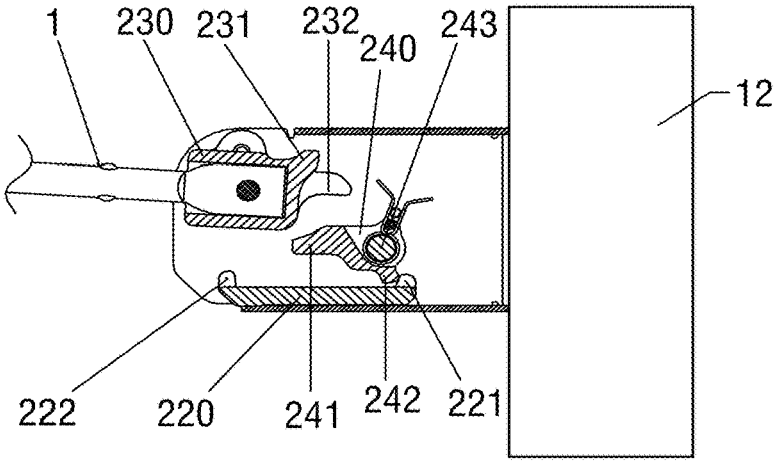
FIG. 7 is a transverse sectional view of the bracket assembly of an automatic door stopping and closing device of an embodiment of the invention when the door is closed.
Figure 8:
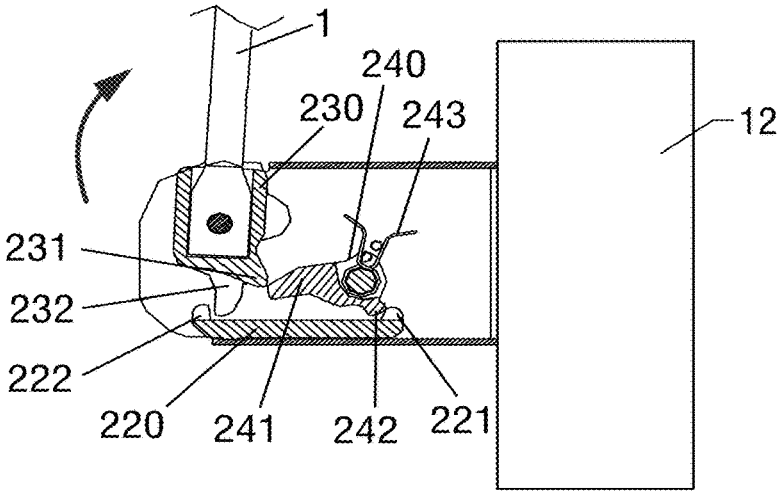
FIG. 8 is a transverse sectional of the bracket assembly of an automatic door stopping and closing device of an embodiment of the invention when the door is opening.

When the door is opening, the connecting rod 1 drives the hook 230 to move clockwise under external force, thereby the hook 230 comes in contact with the movable lug 240 and drives the movable lug 240 to rotate counterclockwise, as shown in FIGS. 7 and 8. When the movable lug 240 rotates to its limit position, the external force will disappear. Then the movable lug 240 will rotate clockwise to its stop position (FIG. 9) under a first reset force, whereby the hook 230 is locked by the movable lug 240, and the door is stopped and held open in a lockout condition.

Figure 11:
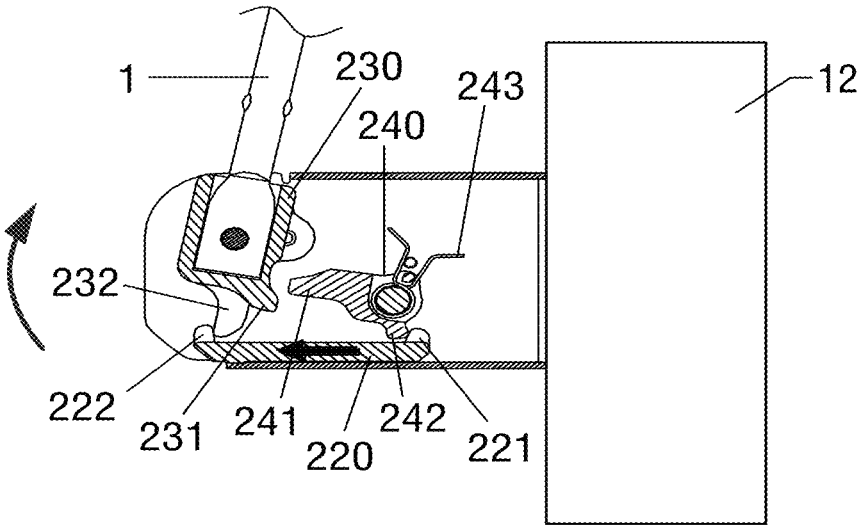
FIG. 11 is a transverse sectional view of the bracket assembly of an automatic door stopping and closing device of an embodiment of the invention in Step 1 of door closing.

In order to close the door from the hold-open position, the door is opened slightly further, such that the connecting rod 1 drives the hook 230 to further move clockwise under external force, whereby the hook 230 comes in contact with the pull rod 220 and drives the pull rod 220 to slide leftwards, as shown in FIG. 11. Further, the pull rod 220 drives the movable lug 240 to rotate clockwise, thereby the movable lug 240 and the hook 230 are disengaged from each other and are unlocked. After the movable lug 240 and the hook 230 are unlocked, the external force will disappear, and then the connecting rod 1 drives the hook 230 to rotate counterclockwise under a door-closing force, making the hook 230 come in contact with the movable lug 240 and further drive the movable lug 240 to rotate clockwise until the hook 230 and the movable lug 240 are spaced apart from each other. After the hook 230 and the movable lug 240 are separated (FIG. 11), the hook 230 can rotate counterclockwise under the door-closing force (FIG. 12), and the movable lug 240 rotates counterclockwise to its initial position under a second reset force.

The first reset force and the second reset force are in opposite directions.

Figure 4:
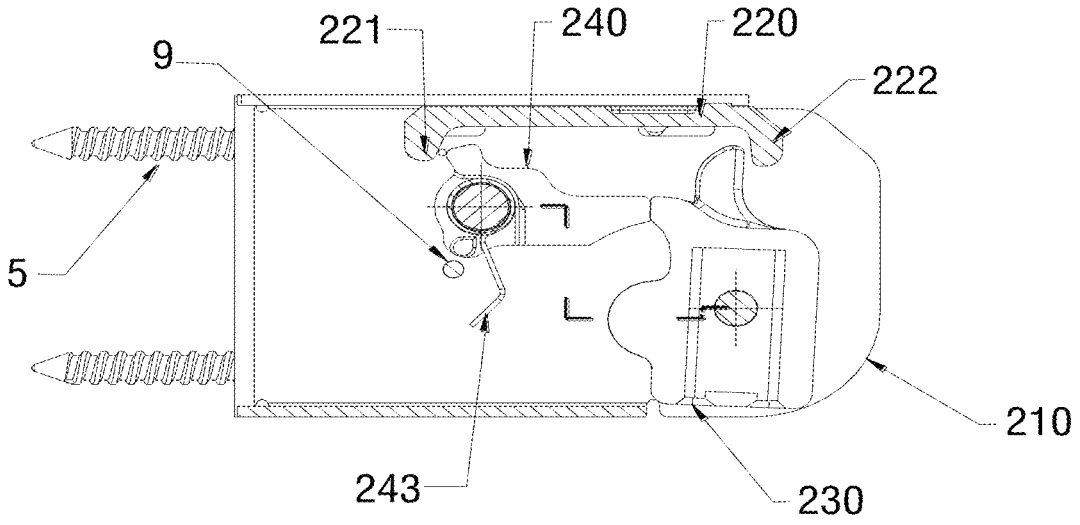
FIG. 4 is a traverse sectional view of the bracket assembly of an automatic door stopping and closing device of an embodiment of the invention.
Figure 5:
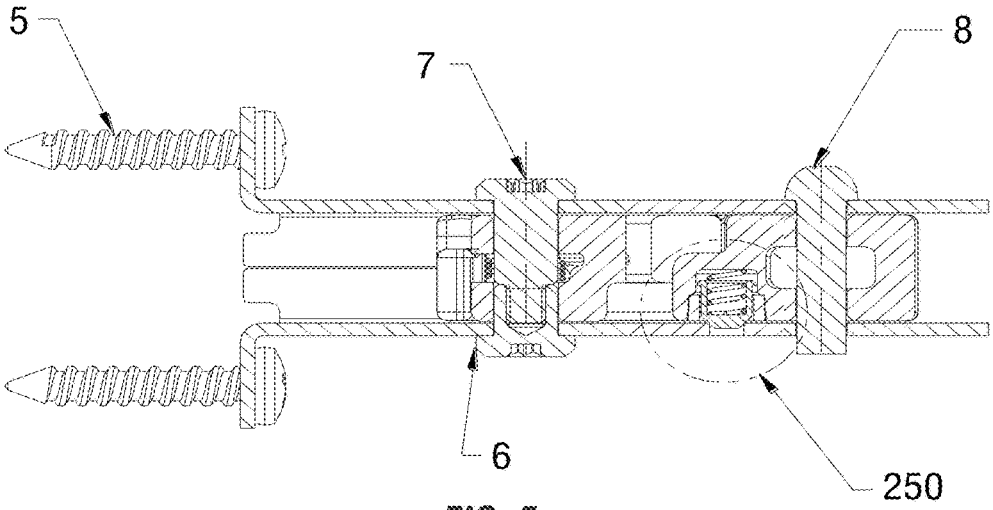
FIG. 5 is a longitudinal sectional view of the bracket assembly of an automatic door stopping and closing device of an embodiment of the invention.
Figure 6:
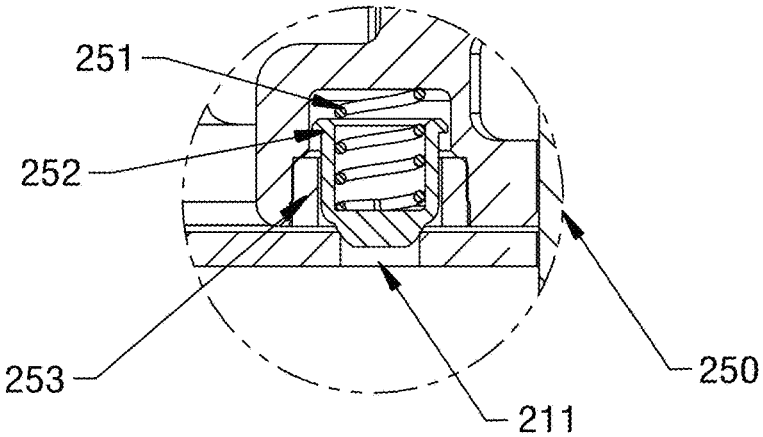
FIG. 6 is an enlarged sectional view from FIG. 5 of the dowel pin of an automatic door stopping and closing device of an embodiment of the invention.

As shown in FIGS. 4, 5 and 6, the hook 230 is configured with a first hook tooth 231 cooperated with the movable lug 240 and a second hook tooth 232 cooperated with the pull rod 220. The movable lug 240 is configured with a first lug tooth 241 cooperated with the hook 230 and a second lug tooth 242 cooperated with the pull rod 220. A torsional spring 243 is configured in the movable lug 240, and the first reset force and the second reset force are the reset force of the torsional spring 243. The pull rod 220 is configured with a first protrusion 221 cooperated with the movable lug 240 and a second protrusion 222 cooperated with the hook 230. The pull rod 220 is in a long strip shape, and the first protrusion 221 and the second protrusion 222 are configured at the two ends of the pull rod 220 respectively.

The bracket assembly 2 also comprises a housing 210, and the hook 230, the movable lug 240 and the pull rod 220 are located therein. A dowel pin 250 is configured in the hook 230 and a dowel pin hole 211 matched with the dowel pin 250 is configured in the housing 210. The dowel pin 250 comprises a fixing ring 253, a pin body 252 configured in the fixing ring 253 and a spring 251 configured in the pin body 252. When the movable lug 240 rotates to its limit position, the dowel pin body 252 sets into the dowel pin hole 211 (FIG. 6).

The housing 210 is preferably configured with an espagnolette 9 which extends through the housing for fastening.

The connecting rod 1 is preferably connected with the door by a hinge 3.

The bracket assembly 2 preferably comprises an extension sheet 4 where a number of screw holes 410 are provided. The screw holes 410 are configured to be fixed to the door frame in cooperation with self-tapping screws 5.

The automatic door stopping-closing device of the embodiment operates as follows.

FIG. 1 and FIG. 7 shows the automatic door stopping-closing device of the embodiment when the door 11 is closed wherein the hook 230 and the movable lug 240 are apart from each other and the movable lug 240 is in its initial position.

Figure 9:
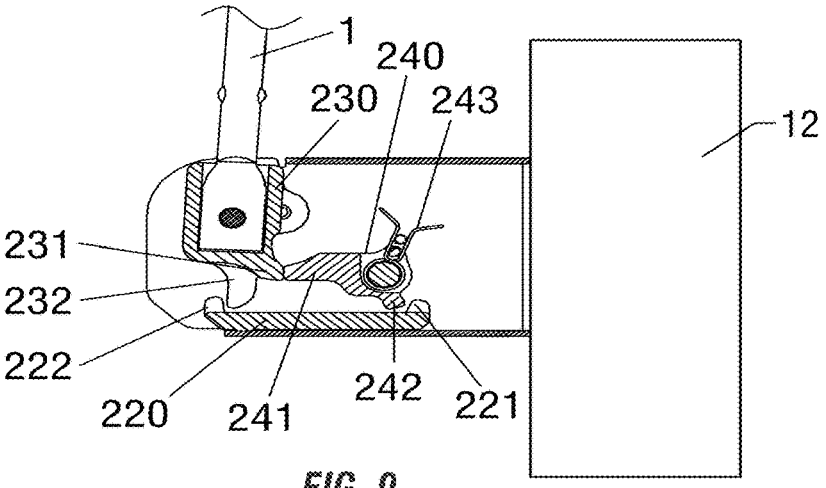
FIG. 9 is a transverse sectional view of the bracket assembly of an automatic door stopping and closing device of an embodiment of the invention when the door is stopped in a hold open position.

FIG. 8 shows the automatic door stopping-closing device of the embodiment when the door 11 is opening, wherein the connecting rod 1 rotates in a direction indicated by the arrow shown in the figure, and the connecting rod 1 drives the hook 230 of the bracket assembly 2 to move clockwise, whereby the first hook tooth 231 comes in contact with the first lug tooth 241, and further drives the movable lug 240 to rotate counterclockwise until the movable lug 240 rotates to its limit position. Meanwhile, as shown in FIG. 6, the pin body 252 of the dowel pin 250 will be pressed into the dowel pin hole 211 by the spring 251 and cause a sound which remind the user to stop pushing the door. As shown in FIG. 9, the movable lug 240 in its limit position is driven by the first reset force offered by the torsional spring 243 and rotates clockwise to its stop position, whereby the first hook tooth 231 of the hook 230 will be locked as the first lug tooth 241 of the movable lug 240 bears against it, thus a function of stopping and holding the door open is achieved.

Figure 10:
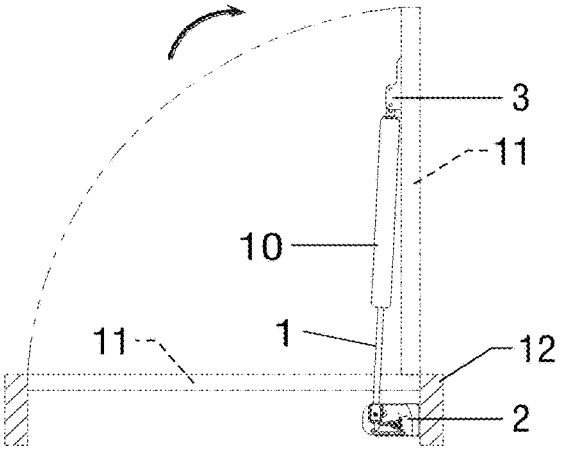
FIG. 10 is an assembly diagram of an automatic door stopping and closing device of an embodiment of the invention when the door is stopped.

As shown in FIG. 10 and FIG. 11, when the door is further pushed to its limit after the door is stopped, in the automatic door stopping-closing device of the embodiment, the connecting rod 1 rotates and drives the hook 230 to rotate, thereby the second hook tooth 232 of the hook 230 comes in contact with the second protrusion 222 of the pull rod 220, and further drives the pull rod 220 to slide in a direction indicated by the arrow shown in the figure. The first protrusion 221 of the pull rod 220 comes in contact with the second lug tooth 242 of the movable lug 240 and further drives the movable lug 240 to rotate counterclockwise, whereby the hook 230 and the movable lug 240 are moved apart from each other and unlocked. Step 1 of door closing is completed.

Figure 12:
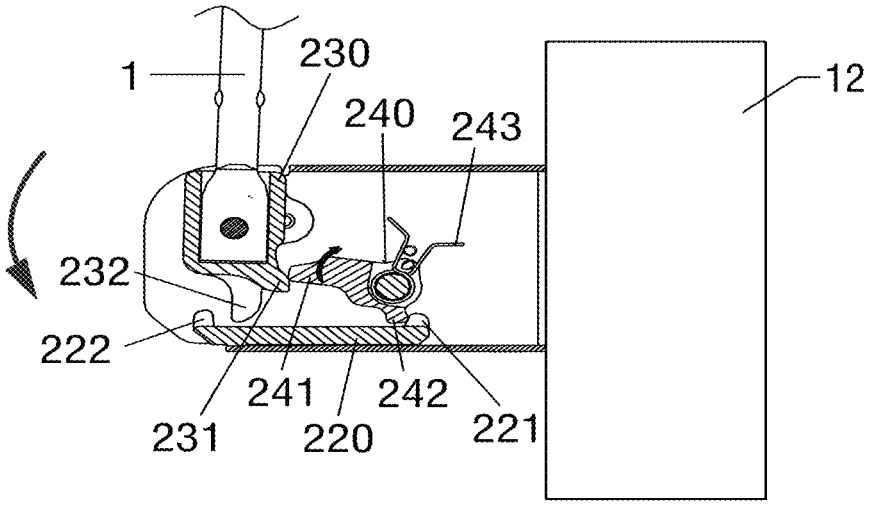
FIG. 12 is a transverse sectional view of the bracket assembly of an automatic door stopping and closing device of an embodiment of the invention in Step 2 of door closing.

As shown in FIG. 12, the door 11 will be closed automatically when the user no longer pushes the door. The connecting rod 1 rotates and drives the hook 230 to rotate counterclockwise, thereby the first hook tooth 231 comes in contact with the first lug tooth 241 and further drives the movable lug 240 to rotate clockwise as indicated by the arrow in the figure until the hook 230 and the movable lug 240 are moved apart from each other. At that moment, the movable lug 240 rotates counterclockwise to its initial position under the second reset force offered by the torsional spring 243. Meanwhile, as the hook 230 rotates counterclockwise to a position where the hook 230 is located when the door is closed, the spring 251 of the dowel pin 250 returns and the pin body 252 leaves the dowel pin hole 211. Step 2 of door closing is completed. At that time, the bracket assembly 2 has a same inner structure with FIG. 7, and the function of closing a door automatically when the door is open is achieved.

The above contents illustrate a completed working cycle of stopping and closing the door for the automatic door stopping-closing device of the present embodiment. The automatic door stopping-closing device enables a stable and effective automatic door stopping-closing.

Those described above are just some preferred embodiments of the invention, instead of any formal restrictions of the invention. Therefore, any simple amendments, equivalent variants and modifications to above embodiments according to the technical essence of the present invention, without departing from the technical solution of the present invention, still fall in the technical scope of the technical solution of the present invention.

What is claimed is:

1. A door closer device for controlling closing of a door mounted in a door frame, comprising:

a cylinder pivotally mounted to the door;

a bracket fixed to the door frame;

a rod with a first end in the cylinder and a second end pivotally connected to the bracket, and the connecting rod being extendable and retractable relative to the cylinder;

a lug pivotally mounted in the bracket for rotation between a first position engaging the rod to hold the door open and a second position disengaged from the rod to allow the door to close;

the lug being biased to the first position when the door is closed and being rotatable in opposite directions from the first position; and the lug is in the first position when the door is closed and when the door is held open.

2. The door closer device of claim 1 further comprising a spring in the bracket to bias the lug between the first and second positions.

3. The door closer device of claim 1 wherein the lug pivots in a first direction to engage the rod and pivots in an opposite second direction to disengage the connecting rod.

4. The door closer device of claim 1 further comprising a pull rod in the bracket slidable in one direction by the lug and slidable in an opposite direction by the second end of the connecting rod.

5. The door closer device of claim 1 wherein the cylinder is pneumatic.

6. The door closer device of claim 1 wherein the cylinder is hydraulic.

7. The door closer device of claim 1 further comprising a slide member in the bracket slidable between a first position disengaged from the rod when the lug holds the door open and a second position to rotate the lug to its second position.

8. The door closer device of claim 7 wherein the slide member is moved to its second position by the rod.

9. The door closer device of claim 7 wherein the slide member is moved to its first position by the lug.

10. A method of controlling positions of a hinged door, comprising:

extending a rod of a cylinder mounted to the door as the door opens; then engaging a lug in a bracket on a frame surrounding the door with an end of the extended rod to hold the door open at a first distance without external force;

opening the door a further distance so as to disengage the rod from the lug;

upon release of the door from the further distance, retracting the rod to close the door;

wherein the lug rotates in a first direction from an initial position when the door moves towards the first distance and rotates in an opposite direction from the initial position when the door moves to the further distance; and the lug is in the initial position when the door is closed and when the door is held open.

11. The method of claim 10 further comprising rotating the lug out of engagement with the rod when the door is opened to the further distance.

12. The method of claim 11 further comprising sliding a member in the bracket when the door is opened to the further distance to rotate the lug out of engagement with the rod.

13. The method of claim 10 further comprising biasing the lug between rod engaging and disengaging positions.

* * * * *